US005426875A

United States Patent [19]

Rickards

[11] Patent Number: 5,426,875

[45] Date of Patent: Jun. 27, 1995

[54] REVERSIBLE TOOTH WITH ADJUSTABLE ATTACK ANGLE

[75] Inventor: Brian Rickards, Fremont, Calif.

[73] Assignee: Pengo Corporation, Union City, Calif.

[21] Appl. No.: 229,262

[22] Filed: Apr. 18, 1994

[51] Int. Cl.[6] ..... F02F 9/28

[52] U.S. Cl. ..... 37/454; 37/449; 37/452; 299/91

[58] Field of Search ..... 299/89, 88, 90, 91; 175/383, 384, 385; 37/142, 141, 103, 117.5, 450, 451, 452, 453, 454, 455, 456

[56] References Cited

U.S. PATENT DOCUMENTS

| | | | |
|---|---|---|---|
| 783,764 | 2/1905 | Thomas | 37/452 |
| 2,578,014 | 12/1951 | Petersen . | |
| 2,877,574 | 3/1959 | Petersen . | |
| 2,952,085 | 9/1960 | Petersen . | |
| 3,063,175 | 11/1962 | Petersen . | |
| 3,136,077 | 6/1964 | Troeppl | 37/142 |
| 3,828,951 | 8/1974 | Fleming | 37/141 X |
| 3,889,405 | 6/1975 | Ranini | 37/141 |
| 3,919,792 | 11/1975 | Hahn et al. | 37/142 |
| 3,932,951 | 1/1976 | Scott et al. | 37/86 |
| 5,152,087 | 10/1992 | Magunia-Larud | 37/141 |

*Primary Examiner*—Randolph A. Reese
*Assistant Examiner*—Robert Pezzuto
*Attorney, Agent, or Firm*—Townsend and Townsend Khoruie and Crew

[57] ABSTRACT

A reversible tooth includes alternate surfaces mounting to a shank plate. The surfaces are constructed so that the attack angle of the tooth, i.e., the angle at which the tooth penetrates the earth, is changed by turning the tooth over and alternating the mounting surface secured to the shank plate.

11 Claims, 4 Drawing Sheets

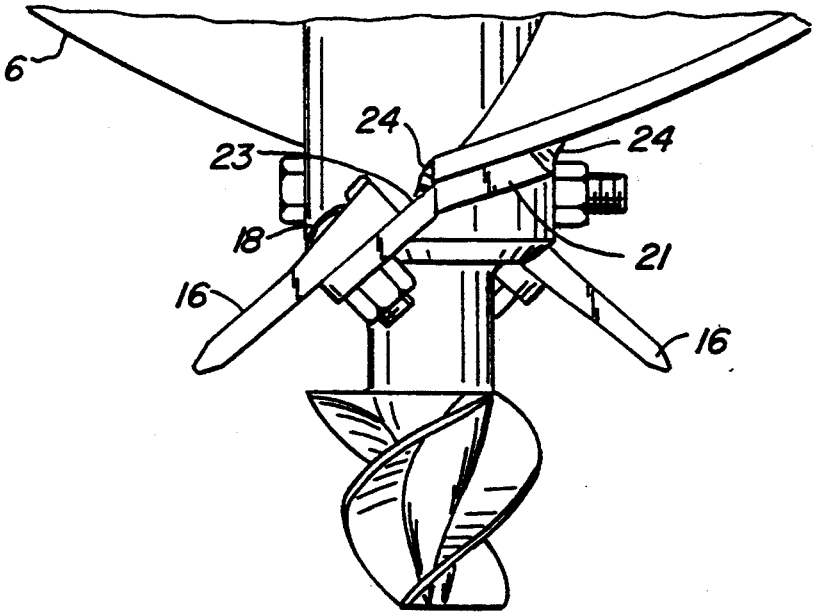
FIG. 2.
FIG. 3.
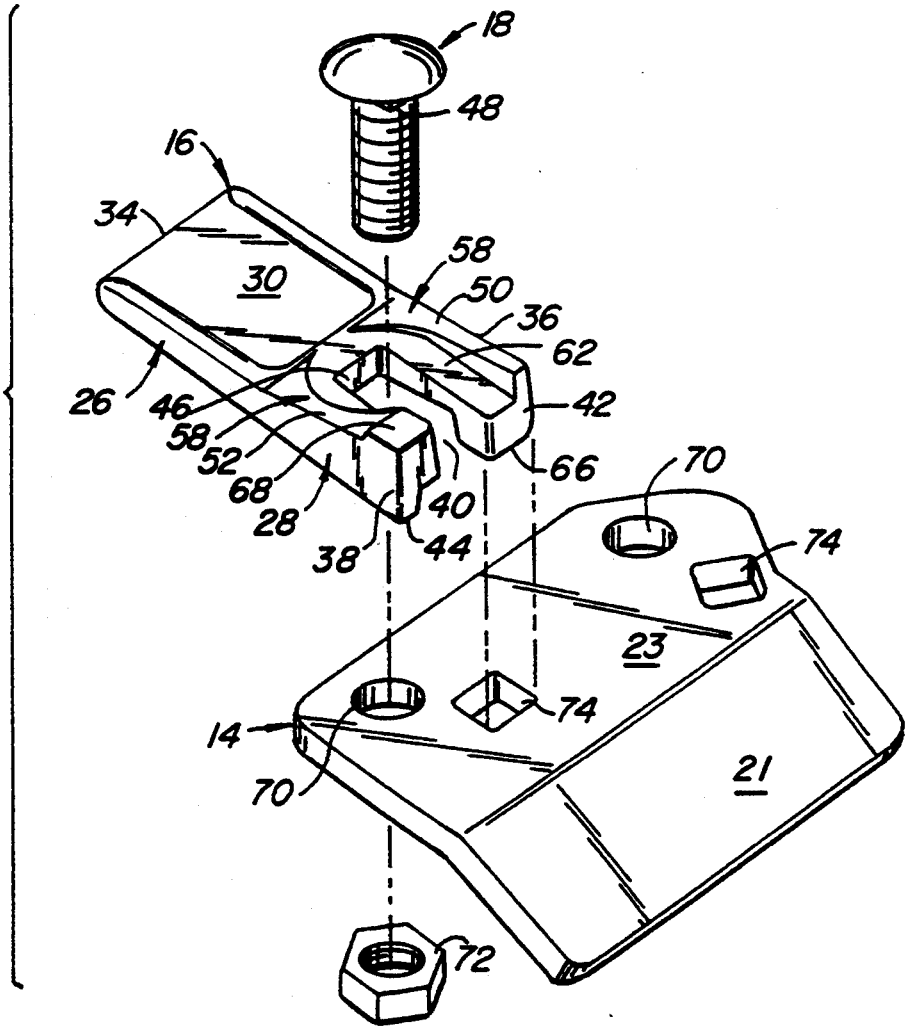

REVERSIBLE TOOTH WITH ADJUSTABLE ATTACK ANGLE

CROSS-REFERENCE TO RELATED APPLICATION

This patent application is related to U.S. patent application No. 08/228,997 filed Apr. 18, 1994 titled Excavating Tooth and Shank Plate Assembly.

BACKGROUND OF THE INVENTION

The present invention relates to a reversible tooth for earth-digging equipment such as augers and the like generally, and more particularly to a reversible tooth having a variable attack angle.

Earth augers generally comprise a boring head and spiral flighting for conveying spoil from the boring head to the surface of the area being excavated. The boring head typically includes shank plates to which excavating teeth are mounted at a fixed attack angle, which is the angle at which the tooth enters the earth being excavated. Augers are generally application specific and provide an attack angle suitable only for that application.

Boring machines used in the agricultural and fencing industries typically have low torque outputs and relatively low downforce capabilities. Because of these limited torques and downforce capabilities the auger generally is selected to provide a very inert attack angle. This helps the auger "shave" the material and generally does not place an undesirable load on the machine. However, when a hard stratum is encountered, such as clay, this inert or relatively flat attack angle does not allow the auger to penetrate effectively into that stratum. The auger then must be replaced with a completely different auger having a greater attack angle. Otherwise, drilling rates would significantly decrease and tooth failure might result.

SUMMARY OF THE INVENTION

The present invention is directed to an excavating tooth that avoids the problems and disadvantages of the prior art. The invention accomplishes this goal by providing a reversible tooth having a distal and proximal portion with differently oriented mounting surfaces, which are adapted for alternate mounting to a shank plate. More specifically, the mounting surfaces converge toward the distal portion and form different angles with a plane generally bisecting the distal portion. With this construction, the attack angle of the tooth can be changed by turning the tooth over and alternating the mounting surface secured to the tooth holder or shank plate. Thus, a tooth constructed to provide interchangeable 40° and 50° attack angles can be used to dig soft agricultural soil at a 40° attack angle and then reversed when a relatively hard stratum is encountered.

A further advantageous aspect of the present invention is the provision of bolt head seating surfaces in the proximal portion which permit the locking bolt to be maintained substantially perpendicular to the tooth so that the tooth can be securely fastened to a shank plate. In the preferred embodiment, one seating surface is parallel to one of the mounting surfaces and the other seating surface is parallel to the other mounting surface.

According to another aspect of the present invention, the tooth is configured for forming a positive interlock with a tooth holder, such as a shank plate, at all times. The proximal portion of the tooth includes an aperture for receiving a fastener, such as a bolt, for securing the mounting surface of the tooth to the shank plate. The tooth is provided with a lug that extends beyond a respective mounting surface for cooperating with a recess formed in the shank plate.

The lug is configured to snugly fit in the recess so that the lug always is sufficiently in contact with the inner wall(s) of the recess to prevent relative movement therebetween. In this manner, the lug prevents tooth rotation or oscillation about the bolt when the tooth is bolted to the plate and the lug is secured in the recess. With the tooth secured against such rotational and oscillatory movement, it can more effectively dig into the earth being excavated. In addition, as the tooth digs into the earth, forces placed on the tooth are transferred to the shank plate through the lug due to the positive contact between the lug and shank plate. This reduces stress transfer through the fastener, thereby increasing the life of the fastener. In accordance with the preferred embodiment, the lug is tapered to provide the desired snug fit in the shank plate recess and prevent relative movement between the lug and shank plate, while allowing for manufacturing tolerances. In the preferred embodiment, a lug is provided on opposite sides of the tooth and oriented to extend beyond each tooth mounting surface. In this manner, the tooth can be readily reversed by loosening the bolt and removing one lug from the recess, turning the tooth over and inserting the other lug into the recess and tightening the bolt.

The above is a brief description of some deficiencies in the prior art and advantages of the present invention. Other features, advantages and embodiments of the invention will be apparent to those skilled in the art from the following description, accompanying drawings and appended claims.

BRIEF DESCRIPTION OF THE DRAWINGS

FIG. 2 is the auger assembly of FIG. 1 rotated 90° ;

FIG. 3 is an exploded view of one of the shank plates of FIG. 1;

DESCRIPTION OF THE PREFERRED EMBODIMENT

Figure 1:
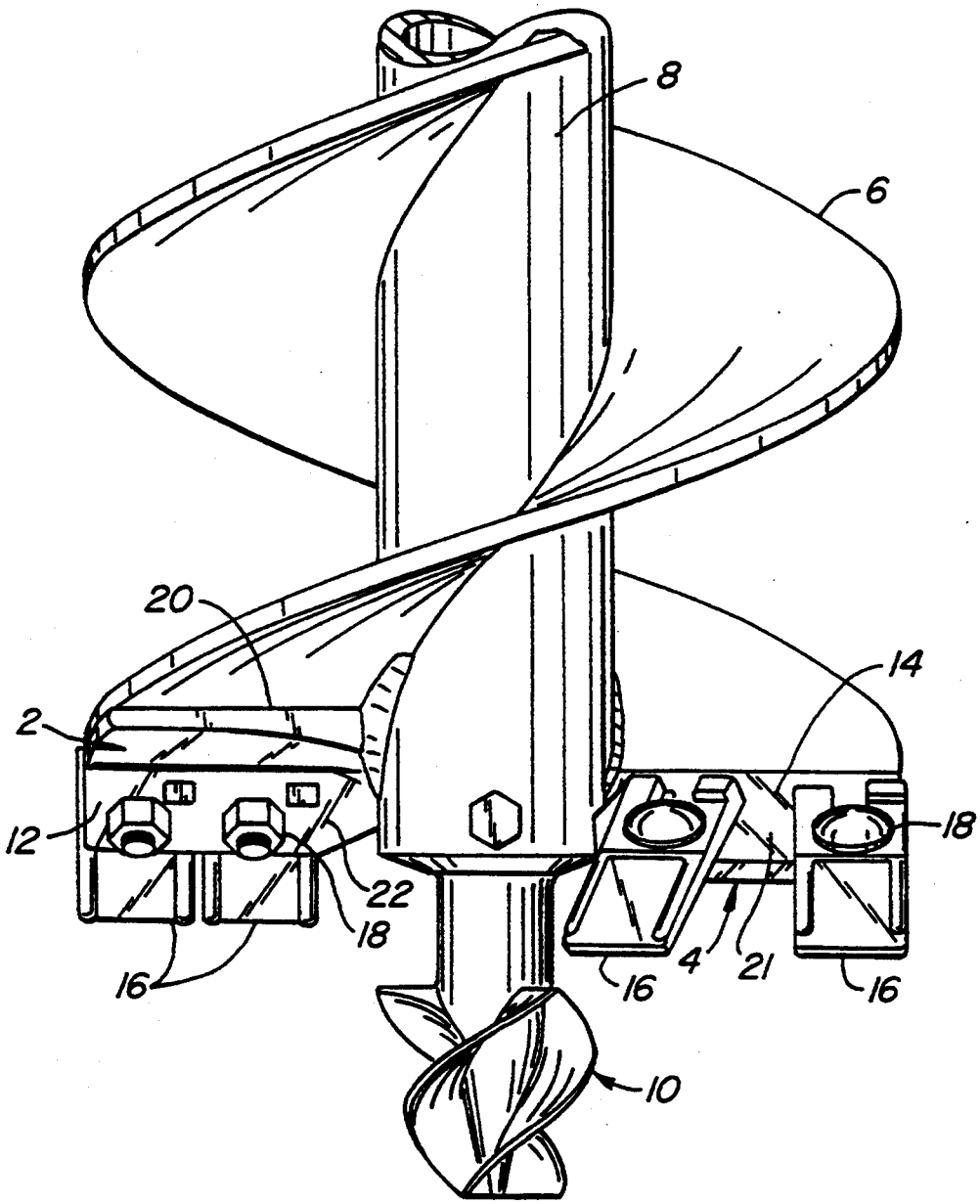
FIG. 1 is a side view of an auger assembly in accordance with the principles of the present invention.

Referring to the drawings in detail, wherein like numerals indicate like elements, FIG. 1 illustrates tooth and shank assemblies 2 and 4 constructed in accordance with the present invention. Shank assemblies 2 and 4 are shown secured to flighting 6 which is helically wound around auger shaft 8 to convey spoil to the surface of the area being excavated as is conventional in the art. In the embodiment illustrated in FIG. 1, pilot head 10 also is provided to cut clearance for auger shaft 8. Although a four tooth arrangement is shown, which is suitable for 12, 16, 18, 24 and 30 inch diameter boring heads, for example, other arrangements can be used to accommodate these other boring head dimensions as would be apparent to one of ordinary skill.

Shank plate assemblies 2 and 4 generally include shank plates 12 and 14, drilling elements or teeth 16, and fasteners 18, which secure the teeth to the shank plates. Shank plates 12 and 14 each include a first portion 20, 21 for securing the shank plate to the flighting and a second portion 22, 23 to which the teeth are secured. Referring to FIG. 2, first portions 20 and 21 can be secured to the flighting by welding, as indicated by reference numeral 24, for example. Shank plates 14 and 16 differ in the arrangement of their tooth mounting holes, which will be discussed in more detail below, so that one of the teeth can be angled radially inwardly, as shown in FIG. 1, to ensure that clearance is cut for auger shaft 8. Since the configuration of each tooth 16 and its attachments to shank plate 12 or 14 is essentially identical, only a single tooth and its attachment to a shank plate will be discussed in detail below.

Tooth 16 includes a distal portion 26 and a proximal portion 28. Distal portion 26 includes top and bottom faces 30 and 32 which terminate in digging or cutting end 34. The distal portion can be tapered as is conventional in the art and shown in the drawings in which faces 30 and 32 are angled downwardly in the forward direction toward end 34. Proximal portion 28, which is configured for fastening the tooth to the shank plate, includes two laterally spaced prongs 36 and 38 which form slot 40 therebetween. As shown in FIG. 3, slot 40 extends forwardly from the proximal ends 42 and 44 of the prongs to wall 46.

Figure 5:
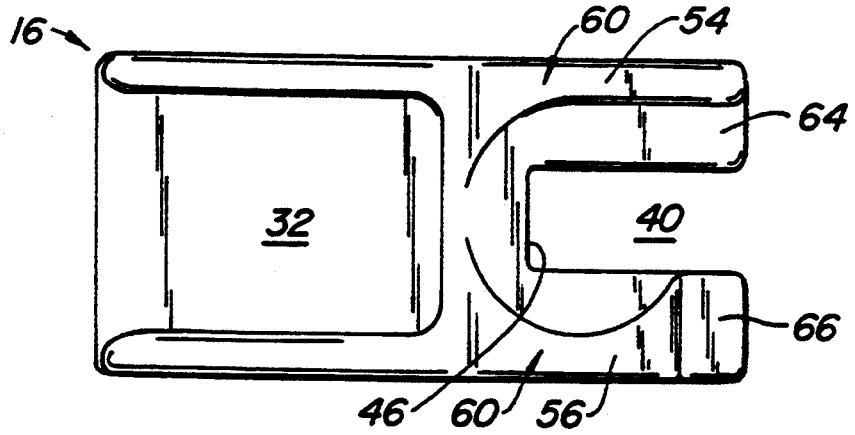
FIG. 5 is a bottom plan view of the tooth shown in FIG. 3.

Slot 40 preferably is rectangular in shape with wall 46 being substantially planar, as shown in FIGS. 3 and 5, to cooperate with a square shanked fastener. That is, fastener 18 preferably is a carriage bolt having a square upper shank portion 48, which is dimensioned to fit snugly in slot 40. The engagement of the square neck 48 with the side edges of slot 40 prevents the tooth from getting out of alignment with the shank plate and prevents relative rotation between fastener 18 and tooth 16.

Each prong has a top face 50, 52 and a bottom face 54, 56. Each face pair 50, 52 and 54, 56 preferably forms a substantially flat mounting surface 58, 60 for mounting the proximal portion of the tooth to a shank plate as will be discussed in more detail below. Prongs 36 and 38 also have depressions formed therein to form bolt head seating surfaces 62 and 64 adjacent or around slot 40 (see, e.g., FIGS. 3 and 5).

In accordance with the present invention, a fastener, such as a bolt and nut fastener, and a locking lug which extends from each tooth are used to secure each tooth to a respective shank plate. Accordingly, each shank plate includes a bolt hole and a lug-receiving recess or through hole for each tooth to be mounted thereon. As exemplified in FIG. 3, shank plate 14 includes bolt hole 70 and lug recess 4. Fastener 18 extends through hole 70 so that nut 72 can be secured to the threaded end of the fastener to lock the proximal portion of tooth 16 against generally planar shank plate mounting surface 23. Lug receiving recess or hole 74 receives either lug 66 or 68 depending on the position of tooth 16.

Figure 6:
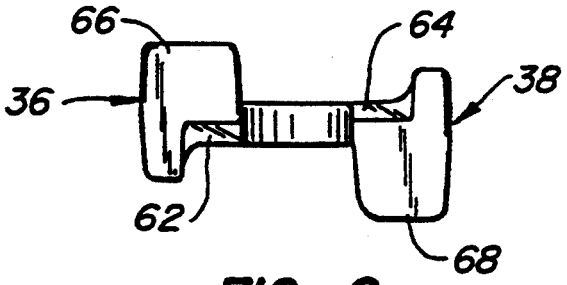
FIG. 6 is an end view of the tooth of FIG. 5.

Referring to FIG. 6, prong 36 includes lug 66 and prong 38 includes lug 68. Each lug extends beyond and generally perpendicular to the portion of the mounting surface 58, 60 adjacent thereto. When one of those mounting surfaces 58, 60 is seated against the corresponding mounting surface of the shank plate to mount the proximal portion of the tooth to the shank plate, the tooth and shank plate mounting surfaces abut one another while the lug extends into the lug recess such as recess 74. Specifically, lug 66 extends beyond mounting surface 60 and lug 68 extends beyond mounting surface 58. Lugs 66 and 68 each have a configuration generally corresponding to that of recess 74 and are dimensioned to snugly fit in that recess so that the lug always is sufficiently in contact with an inner wall(s) of the recess to prevent relative movement therebetween and transfer forces from the tooth to the shank plate. In this way, stress transfer through the bolt is minimized, thereby enhancing the life of fastener 18. That is, the interlock between the lug and the shank plate reduces the load on the fastener.

As shown in the drawings, each lug preferably is tapered to provide the desired fit within a respective recess 74. Although a lug having a generally rectangular sectional configuration is shown, it should be understood that other configurations can be used without departing from the scope of the present invention. For example, the lug can have a circular, triangular, pentagonal or hexagonal cross section.

Referring to FIGS. 3–6, the preferred arrangement of locking lugs for a reversible tooth is shown. Specifically, locking lug 66 extends from the bottom of prong 36, while locking lug 68 extends from the top of prong 38. Thus, when tooth 16 is positioned with top face 30 of the tooth facing upwardly as shown in FIG. 3, lug 66 cooperates with recess 74. However, when the tooth is reversed such that bottom face 32 of the tooth faces upwardly, lug 68 cooperates with recess 74. Thus, the configuration of lugs 66 and 68 preferably are essentially identical.

Figure 4:
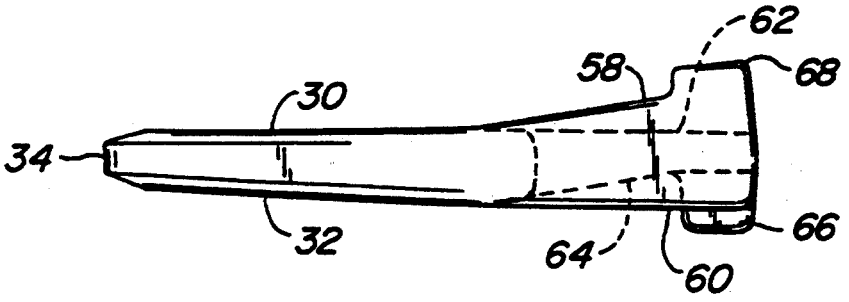
FIG. 4 is a side view of the auger tooth shown in FIG. 3.
Figure 7A:
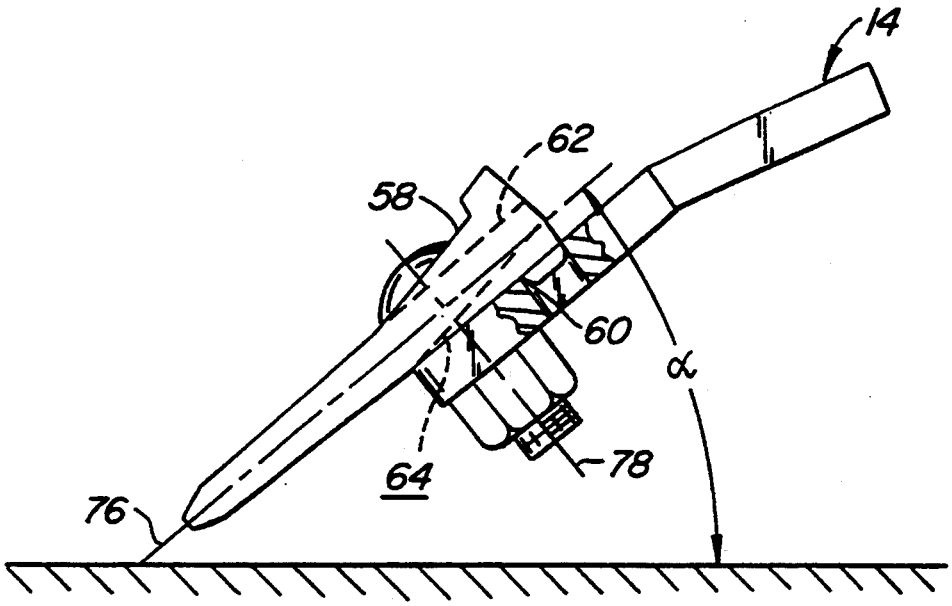
FIG. 7A is a side view of the tooth of FIG. 5 mounted to a shank plate in a first position.
Figure 7B:
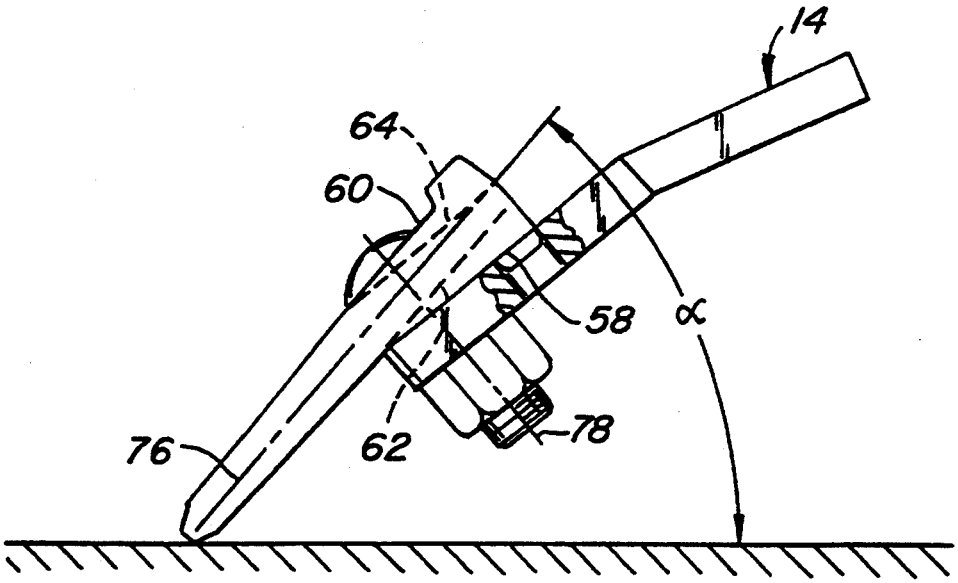
FIG. 7B is a side view of the tooth of FIG. 5 mounted in a reversed position.

Referring to FIGS. 3, 4, and 7, the mechanism for varying the attack angle of the tooth will be described. As shown in the drawings, mounting surface 60 is generally coplanar with bottom face 32 of distal portion 26, but mounting surface 58 is not coplanar with top face 30 of distal portion 26. That is, mounting surfaces 58 and 60 are substantially nonparallel. In this manner, the attack angle, designated with reference character $\alpha$, can be changed when the position of the mounting surfaces are alternated and the tooth is reversed from the position shown in FIG. 7A to that shown in FIG. 7B. In the preferred embodiment, the mounting surface 58 forms an angle with mounting surface 60 of at least about 5°, which results in a corresponding change in $\alpha$ of at least about 5°. In other words, when the tooth is reversed from the position shown in FIG. 7A to that shown in FIG. 7B, the angle formed between a plane 76 that bisects the top and bottom faces of distal portion 26 and a plane extending transversely through the shank plate and parallel to the longitudinal axis of fastener 18 as designated by reference numeral 78, for example, changes by an amount equal to the angle formed between the mounting surfaces 58 and 60.

The orientation of the bolt seating surfaces constitutes another important aspect of the invention. Specifically, bolt seating surface 62 is substantially parallel to tooth mounting surface 60, while bolt seating surface 64 is substantially parallel to tooth mounting surface 58. With this configuration, the bolt is maintained essentially perpendicular to the portion of the shank plate to which the tooth is mounted and the contact area between the bolt head and tooth and the nut and shank plate is maximized to enhance the securement of the tooth to the shank plate.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. An excavating tooth comprising a distal portion and a proximal portion, said proximal portion including an aperture for receiving a fastener therethrough, said proximal portion having an upper surface adapted for mounting against a plate when said tooth is in a first position and a bottom surface adapted for mounting against said plate when said tooth is in a second position, a major portion of said upper surface being oriented in a first plane and a major portion of said bottom surface being oriented in a second plane, said first and second planes converging toward said distal portion.

2. The excavating tooth of claim 1 wherein said first and second planes form an angle of at least about 5° therebetween.

3. An excavating tooth comprising a distal portion and a proximal portion, said proximal portion including laterally spaced prongs that form a slot therebetween for receiving a fastener, said slot extending forwardly toward said distal portion, each prong having an upper surface adapted for mounting against a plate when said tooth is in a first position and a bottom surface adapted for mounting against said plate when said tooth is in a second position, a major portion of said upper surface being oriented in a first plane and a major portion of said bottom surface being oriented in a second plane, said first and second planes converging toward said distal portion.

4. The excavating tooth of claim 3 wherein one of said prongs includes a projection extending beyond one of said upper and lower surfaces for cooperating with a recess formed in said shank plate.

5. An excavating tooth comprising a distal portion and a proximal portion, said proximal portion including laterally spaced prongs that form a slot therebetween for receiving a fastener to couple the tooth to a shank plate, each prong having an upper surface adapted for mounting against said shank plate when said tooth is in a first position and a bottom surface adapted for mounting against said shank plate when said tooth is in a second position, a major portion of said upper surface being generally oriented in a first plane and a major portion of said bottom surface being generally oriented in a second plane, said first and second planes converging towards one another, upper and lower fastener seating surfaces formed in the prongs adjacent the major portions of the upper and lower surfaces, said upper and lower fastener seating surfaces being parallel to the lower and upper seating surfaces, respectively, said upper and lower fastener seating surfaces being generally flat surfaces adjacent said slot for engaging a portion of said fastener when said tooth is in one of said first and second positions.

6. The excavating tooth of claim 5 wherein said first and second planes form an angle of at least about 5° therebetween.

7. A shank plate assembly comprising a shank plate, an excavating tooth, and a fastener coupling said tooth to said plate, said tooth having a distal portion and a proximal portion, said proximal portion including top and bottom mounting surfaces, said fastener releasably coupling one of said mounting surfaces to said plate, said top and bottom mounting surfaces being oriented at an angle to one another so that when the fastener couples the top mounting surface to the plate the distal portion assumes a first angular altitude relative to the plate and when the fastener couples the bottom mounting surface to the plate the distal portion assumes a second angular altitude relative to the plate.

8. The assembly of claim 7 wherein said top and bottom mounting surfaces are at an angle of at least 5° to one another.

9. The assembly of claim 7 wherein said proximal portion includes laterally spaced prongs that form a slot therebetween, said fastener extending through said slot.

10. The assembly of claim 7, further comprising upper and lower fastener seating surfaces formed in the top and bottom mounting surfaces, said upper and lower fastener seating surfaces being parallel to the bottom and top mounting surfaces, respectively, said upper and lower fastener seating surfaces being generally flat surfaces for engaging a portion of said fastener when said tooth is in one of said first and second positions.

11. The assembly of claim 10, wherein the proximal portion includes laterally spaced prongs that form a slot therebetween within which said fastener passes.

* * * * *